US005918631A

United States Patent [19]

Weiler, Jr. et al.

[11] Patent Number: 5,918,631

[45] Date of Patent: Jul. 6, 1999

[54] BALL-POPPET PNEUMATIC CONTROL VALVE

[75] Inventors: Charles A. Weiler, Jr., Holly; Paul G. Storrs, Rochester Hills, both of Mich.

[73] Assignee: Ross Operating Valve Company, Troy, Mich.

[21] Appl. No.: 09/059,954

[22] Filed: Apr. 14, 1998

[51] Int. Cl.[6] ..... F15B 13/042

[52] U.S. Cl. ..... 137/596.18; 91/454; 91/464; 137/596.1; 137/596.14; 137/864; 137/901

[58] Field of Search ..... 91/457, 464; 137/596.1, 137/596.14, 596.18, 864, 901, 596

[56] References Cited

U.S. PATENT DOCUMENTS

| | | | |
|---|---|---|---|
| 2,503,827 | 4/1950 | Langmore et al. | 91/464 X |
| 3,884,266 | 5/1975 | Kondo | 137/625.27 |
| 3,934,610 | 1/1976 | Solie | 137/596.16 X |
| 4,067,357 | 1/1978 | Ruchser | 137/596.18 X |
| 4,111,226 | 9/1978 | Cameron . | |
| 4,754,693 | 7/1988 | Telscher | 91/464 |
| 4,883,091 | 11/1989 | Weiler et al. . | |
| 5,113,907 | 5/1992 | Russell . | |
| 5,567,023 | 10/1996 | Yoo | 137/596.17 X |

OTHER PUBLICATIONS

Ross Operating Valve Company product literature—pp. 709–712 (undated).

*Primary Examiner*—Gerald A. Michalsky
*Attorney, Agent, or Firm*—Harness, Dickey & Pierce, P.L.C.

[57] ABSTRACT

A pneumatic fluid control valve includes a valve body having a fluid inlet connectable to an external source of pressurized pneumatic working fluid, one or more load outlets, one or more corresponding exhaust ports, and a movable valve mechanism. The movable valve mechanism includes at least a pair of movable valve element and preferably resilient deformable connectors in a generally abutting relationship between adjacent movable valve elements for deformably transmitting coordinated motion therebetween. The deformable connector resiliently allows one of the movable elements to move and compress the connector before such coordinated motion is transmitted to the other movable element in order to minimize internal leakage.

38 Claims, 11 Drawing Sheets

BALL-POPPET PNEUMATIC CONTROL VALVE

BACKGROUND AND SUMMARY OF THE INVENTION

The invention relates generally to pneumatic fluid control valves, such as the type used for controlling the flow of pressurized air as a pneumatic working fluid to and from a pneumatically-actuated drive cylinder device, which in turn is used to drivingly actuate a machine or other apparatus. More specifically, the invention relates to such pneumatic control valves that are capable of efficient, fast-acting operation with substantially no internal leakage of pneumatic working fluid.

It is well-known to use pneumatic control valves for controlling the operation of pneumatic fluid-actuated drive mechanisms, such as pneumatic cylinder-and-piston devices used for driving various types of machines or apparatuses, such as presses, process or assembly line devices, or any of a wide variety of other well-known tools or equipment. Such pneumatic fluid control valves are typically required to operate rapidly, slidably and precisely over millions of operating cycles during the lives of the valves themselves and the equipment they are used to control. In addition, due to energy efficiency requirements, precision operating parameters, requirements relating to ambient plant conditions, or other design considerations, such valves are often required to operate with low or minimal, internal leakage of pneumatic working fluid. Although these requirements have been generally well-served by a wide variety of configurations or types of pneumatic fluid control valves currently in use, ever-increasing technological demands, have given rise to the need for even greater levels of performance of such valves.

Accordingly, in accordance with the present invention, a pneumatic fluid control valve apparatus capable of even faster and more precise operation, as well as even lower, near-zero internal working fluid leakage, is provided. A pneumatic fluid control valve apparatus according to the present invention typically includes a valve body portion having a working fluid inlet connectable to an external source of pressurized pneumatic working fluid, one or more working fluid load outlets, one or more corresponding exhaust ports, and a movable valve mechanism disposed within the valve body. The control valve apparatus is connectable to a conventional pilot operator adapted for selectively applying pneumatic fluid pressure to the movable valve mechanism in order to communicate one of the load outlets first with the working fluid inlet and then with a corresponding exhaust port, thus alternately causing pneumatic working fluid to be transmitted to and from a drive actuator device.

The movable valve mechanism of the present invention preferably includes a first movable valve element movably located within a first chamber in the valve body, with the first chamber being in communication with a first working fluid load outlet and a first corresponding exhaust port. A second movable valve element is movably located within a second chamber within the valve body, with the second chamber being in communication with the first chamber, with the working fluid inlet, and with the first working fluid load outlet. The movable valve mechanism may also include a third movable valve element movably located within a third chamber in the valve body portion, with the third chamber being in communication with the second chamber, with a second working fluid load outlet, and with a second corresponding exhaust port. A deformable connector is disposed with the valve body in a generally abutting relationship between the first and second movable valve elements, and a second deformable connector may be disposed between the second and third movable valve elements (if so equipped) for deformably transmitting a coordinated or responsive motion therebetween. A pair of pistons disposed at opposite ends of the valve body portion abuttingly engage the first and second (or the first and third) movable valve elements, respectively, in order to impart such coordinated motion to the movable valve mechanism, thereby selectively communicating the working fluid inlet with one or the other of the working fluid load outlets and to communicate the opposite working fluid load outlet with exhaust.

In a preferred form of the present invention, the deformable connectors are arranged in a substantially straight, linear in-line orientation along the paths of movement of the movable valve elements, which are preferably of a spherical (or at least partially spherical) arcuate shape, at least in the portions that are adjacent their respective valve seats within the valve body. Also in a preferred form of the invention, such deformable connectors are resiliently deformable coil springs, although other resiliently deformable connector configurations can also be employed. The preferred resiliently deformable connectors each resiliently compress to allow one of its adjacent movable valve elements to move a considerable amount before transmitting such coordinated motion to the other of its adjacent movable valve elements in order to move it to the opposite end of its travel.

In addition, in order to minimize wear on the movable valve elements, the preferred coil spring connectors have their ends ground to a generally-spherical, concave arcuate shape that is complementary to the arcuate spherical surface of the adjacent preferred movable valve elements mentioned above.

Such preferred construction of the pneumatic fluid control valve apparatus according to the present invention offers distinct advantages in terms of speed and precision of operation, as well as eliminating, or at least substantially minimizing, undesirable internal cross-over leakage of pneumatic fluid during movement of the valve elements. It should also be noted that the invention can be applied advantageously in a variety of control valve types, including three-way valves, four-way valves, dual three-way valves capable of acting either in parallel or as a four-way valve, as well as in other configurations that will readily occur to those skilled in the art.

Additional objects, advantages, and features of the present invention, however, will become apparent from the following description and the appended claims, taken in conjunction with the accompanying drawings.

DETAILED DESCRIPTION OF THE PREFERRED EMBODIMENTS

Figure 1:
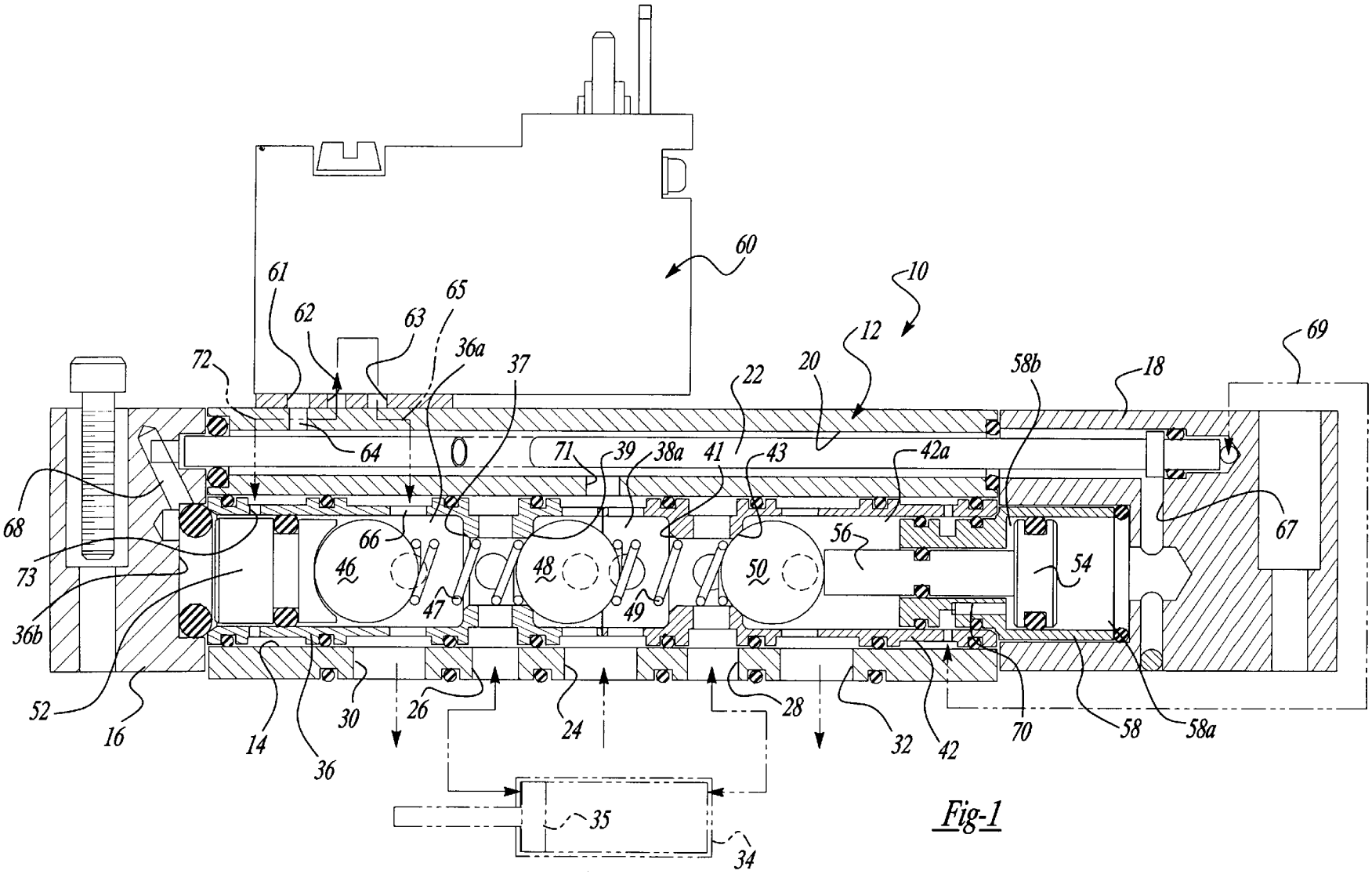
FIG. 1 is a longitudinal cross-sectional view of a five-port, four-way pneumatic fluid control valve apparatus according to the present invention (with certain flow passages shown diagrammatically for clarity), illustrating the valve apparatus in a condition where pneumatic working fluid from the inlet is communicated with one working fluid load outlet and is blocked from fluid communication with the other of the working fluid load outlets, and with the other working fluid load outlet in communication with its associated exhaust port.

FIGS. 1 through 13 illustrate various preferred embodiments of pneumatic fluid control valve apparatuses according to the present invention. One skilled in the art will readily recognize, from the following discussion and the accompanying drawings, that the embodiments of the present invention shown in the drawings are merely exemplary and illustrative of the variety of control valve apparatus mechanisms in which the principles of the present invention can be applied.

Referring first to FIG. 1 through 6, an exemplary five-port, four-way fluid control valve apparatus 10 generally includes a body 12 having a main or central bore 14 extending longitudinally therethrough and being closed off on opposite ends by respective end caps 16 and 18. The body 12 also includes a secondary bore 20, which is generally smaller in diameter and extends longitudinally therethrough, and a hollow flow tube 22 extending through and within the secondary bore 20, between the end caps 16 and 18.

The valve body 12 typically includes a working fluid inlet port 24, a pair of working fluid load ports 26 and 28, and a pair of corresponding respective exhaust ports 30 and 32. In a typical, illustrative application for the control valve apparatus 10, the load ports 26 and 28 are connectable to respective sides or ends of a pneumatic actuating cylinder 34 having a drive piston 35 slidably disposed therein.

A preferred form of the pneumatic control valve apparatus 10 includes a first generally cylindrical sleeve 36, having associated valve seats 37 and 39, and a generally cylindrical sleeve 42 with its associated valve seats 41 and 43, all of which are disposed in a generally straight, linear in-line arrangement within the central or main bore 14 of the valve body 12. The hollow interior of the sleeve 36 defines a first chamber 36*a*, the interiors of the sleeves 36 and 42 together define a second chamber 38*a*, and the interior of the sleeve 42 defines a third chamber 42*a*.

A preferred movable valve element in the form of a spherical ball 46 is disposed for linear longitudinal movement within the sleeve 36 (and thus within the chamber 36*a*) and is sealingly engageable with the valve seat 37. Similarly, a second movable valve element or spherical ball 48 is disposed for longitudinal movement within the chamber 38*a* and is alternately engageable with either of the respective valve seats 39 and 41. In like manner, a third movable valve element or spherical ball 50 is disposed for linear longitudinal movement within the sleeve 42 (and thus within the chamber 42*a*) and is sealingly engageable with the valve seat 43. Deformable valve element connectors, preferably in the form of resiliently deformable spring connectors 47 and 49, are disposed between the adjacent spherical balls 46 and 48 and the adjacent spherical balls 48 and 50, respectively, with the spring connectors 47 and 49 generally abutting their adjacent respective pairs of spherical ball type valve elements in order to resiliently transmit coordinated motion therebetween.

A piston 52 is also disposed within the sleeve 36 in a linearly longitudinally movable, generally abutting relationship with the preferred spherical ball valve element 46. A piston chamber 36*b* is on the left-hand side (as viewed in FIGS. 1 through 6) of the piston 52. Similarly, at the opposite end of the central bore 14, a second piston 54, having an integral longitudinally-protruding rod 56 extending therefrom, is in a generally abutting relationship with the spherical ball valve element 50. The piston 54 with its integral rod 56 are preferably disposed within a piston sleeve 58 for longitudinal movement therein, and the sleeve 58 defines a pair of piston chambers 58*a* and 58*b* therein.

In the embodiment of the present invention illustrated in FIGS. 1 through 6, a single conventional pilot operator 60 is interconnected with the control valve apparatus 10 and includes a first pilot port 61 (pilot supply source), which is in fluid communication with the secondary bore 20 (outside of, and sealingly isolated from, the hollow flow tube 22) by way of a passage 64 through the valve body 12. The secondary bore 20 is in turn in fluid communication with the piston chamber 58*a*, by way of a passage 67 through the valve body 12. Since this communication is always present, the portion of the chamber 58*a* on the right-hand or outboard side of the piston 54 is always pressurized whenever the external source of pneumatic working fluid is "on". A second pilot port 63 (pilot exhaust), in the pilot operator 60, is in fluid communication with the chamber 36*a* (valve exhaust), by way of a diagrammatically-illustrated passage 65 through the valve body 12 and a passage 66 in the sleeve 36. The piston chamber 36*b* is in fluid communication with the isolated inside of the hollow flow tube 22, by way of a passage 68 through the valve body 12. The interior of the isolated flow tube 22 is in fluid communication with the piston chamber 58*b*, by way of a diagrammatically-illustrated passage 69 through the valve body 12 and a passage 70 through the piston sleeve 58. A third pilot port 62 is an internal pilot control port, which is selectively connectable during operation of the pilot 60 (in a conventional manner well-known to those skilled in the art) with either of the pilot ports 61 or 63, in order to effect actuation of the pneumatic control valve apparatus 10, as is described below.

The pilot port 62 is in fluid communication with the piston chamber 36*b* by way of the diagrammatically-illustrated passge 72 and the passage 73 through the sleeve 36. The pilot operator 60 can be electrically-energized, manually-energized, or actuated by any other known, conventional means.

Referring to the sequence depicted in FIGS. 1 through 6, the operation of the pneumatic fluid control valve apparatus 10 is described as follows. In FIG. 1, when the external pneumatic fluid source is "on", pressurized pneumatic working fluid is conveyed through the inlet port 24, into the inlet chamber 38*a* defined by the sleeves 36 and 42, through the passage 71, and into the secondary bore 20, on the outside of the sealed-off flow tube 22. The pressurized working inlet fluid also flows from the chamber 38*a*, through the working fluid load port 28, to one side of the actuating cylinder 34, thus urging the actuating piston 35 to the opposite side of the cylinder 34. Because the pilot operator 60 is electrically de-energized and the pilot output port 62 is at zero pressure, the valve is in the condition shown in FIG. 1. Pressurized pneumatic working fluid flows along the length of the secondary bore 20, through the passage 67 in the right-hand (as viewed in FIG. 1) end cap 18, and into the chamber 58*a* to forcibly act upon the piston 54 and its rod 56. This imparts a leftward force on the spherical ball valve elements 50, 48 and 46, along with their spring connectors 49 and 47 and the piston 52. It should be noted that in the condition illustrated in FIG. 1, the chamber 36*a* is open to the exhaust port 30, and the pilot port 62 is connected with the internal pilot exhaust port 63, so that there is no pressurized pneumatic fluid in the chamber 36*b* on the left-hand end of the piston 52, as viewed in FIG. 1.

Figure 2:
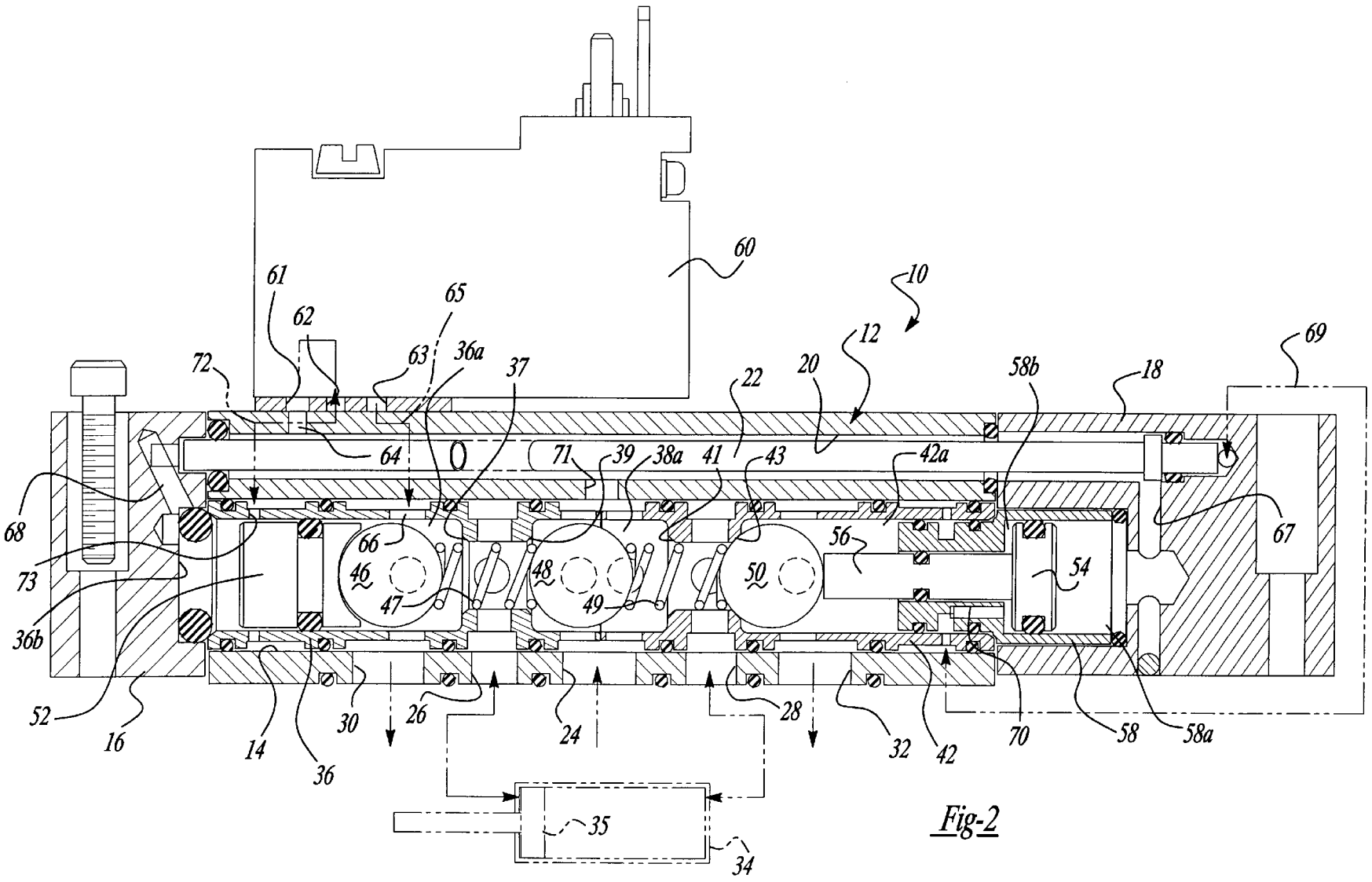
FIG. 2 is a view similar to that of FIG. 1, but illustrating the movable valve mechanism of the pneumatic fluid control valve apparatus in an initial transient movement condition, where it is beginning to allow fluid communication between the working fluid inlet and the other of the pair of working fluid load outlets.

In FIG. 2, the pneumatic control valve apparatus 10 is shown at the beginning of the valve mechanism's rightward movement, resulting from the pilot operator 60 being energized in a conventional manner well-known to those skilled in the art, causing the pilot port 61 to be connected to the pilot port 62. This in turn causes pressurized pneumatic fluid from the portion of the secondary bore 20 (surrounding the flow tube 22) to flow through passage 64. This pressure then flows into the pilot port 61, out of the pilot port 62, through the passage 72, and into the chamber 36*a* by way of the passage 73 in the sleeve 36. This pressurized pneumatic working fluid in the chamber 36*b* forcibly acts in a rightward direction (as viewed in FIG. 2) on the piston 52. Such pressurized pneumatic fluid also flows outwardly from the chamber 36*b*, through the passage 68, and into the sealingly isolated hollow interior of the flow tube 22. From the isolated interior of the flow tube 22, pressurized pneumatic fluid is communicated by way of the diagrammatically-illustrated passage 69 in the valve body 12, through the passage 70 in the sleeve 58, and into the chamber 58*b*, wherein it forcibly acts in a rightward direction (as viewed in FIG. 2) on the annular region of piston 54 and the rod 56.

The pressurized pilot fluid urging the piston 54 in a rightward direction (as viewed in FIG. 2) greatly reduces the leftward force of the pneumatic fluid in the chamber 58*a* acting on the opposite side of the piston 54. Thus, the greatly-reduced leftward force from the piston 54 allows the piston 52 to urge the valve elements 46 and 48 rightwardly to their respective seats 37 and 41 and the valve element 50 to move rightwardly in order to open the load port 28 to the exhaust port 32. As shown in FIG. 2, the spherical ball valve element 46 has begun to move rightwardly, and the spring connector 47 has compressed, thus beginning to urge the spherical ball valve element 48 rightwardly off from its seat 39. It should be noted, however, that due to the resilient compressibility of the spring connector 47, the spherical ball valve element 46 moves a considerable extent before the spherical ball valve element 48 begins to move.

Figure 3:
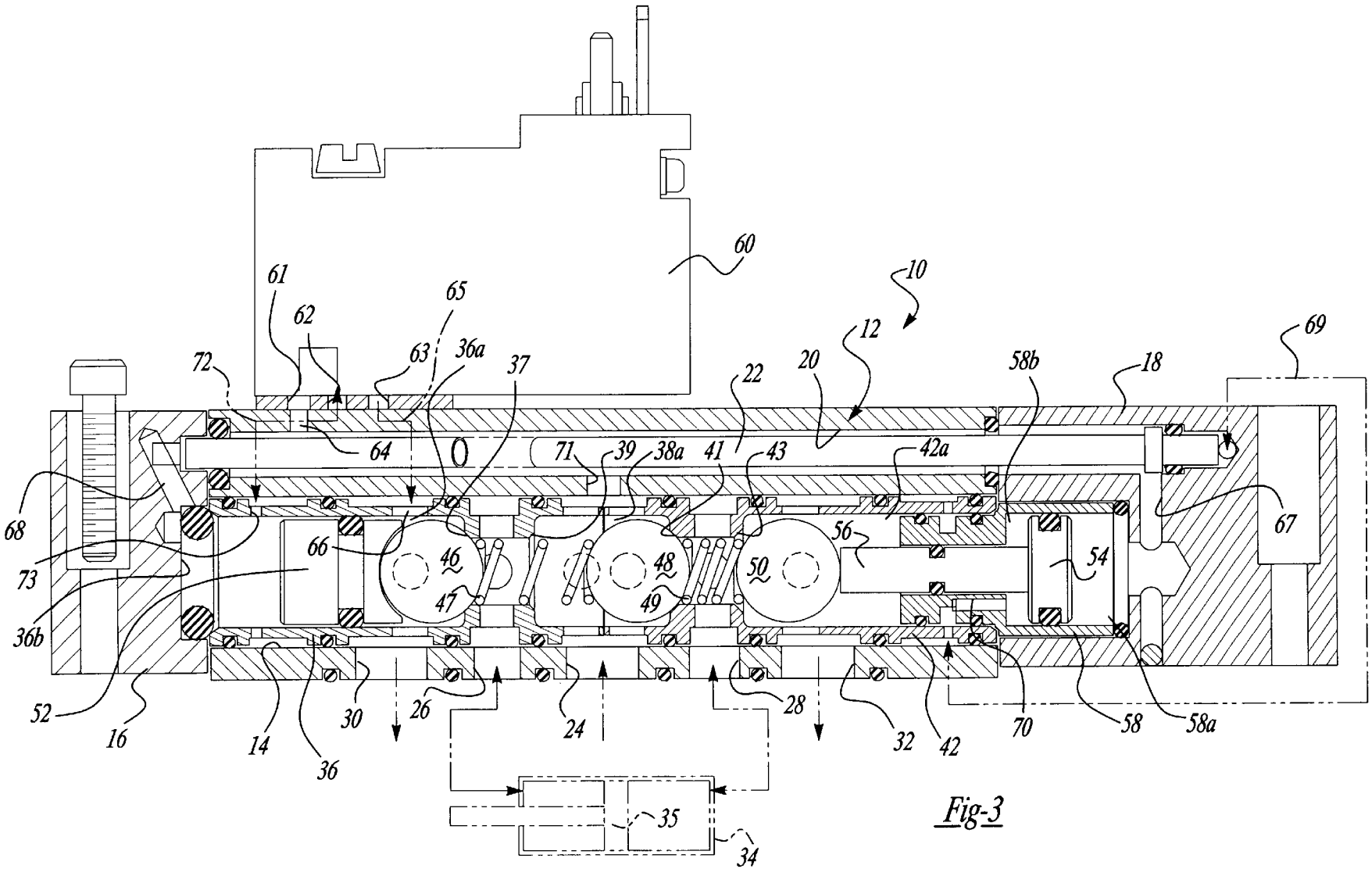
FIG. 3 is a view similar to that of FIG. 2, but illustrating the movable valve mechanism moved further to provide full fluid communication between the working fluid inlet and the other of the working fluid load outlets, and blocking fluid communication between the working fluid inlet and the first-mentioned working fluid load outlet, and beginning the opening of the first-mentioned load outlet to exhaust.

In FIG. 3, the above-described rightward movement of the valve elements shown in FIG. 2 has progressed until the spherical ball valve element 46 is fully seated on the valve seat 37 of the sleeve 36, and due to the "snap-reaction" extension of the previously-compressed coil spring 47, the spherical ball valve element 48 has now moved rightwardly to the point that it is now sealingly seated on the valve seat 41 of the sleeve 42, thus compressing the spring connector 49. Again, it should be pointed out that the spherical ball valve element 48 has moved considerably before the valve element 50 has begun to move.

Figure 4:
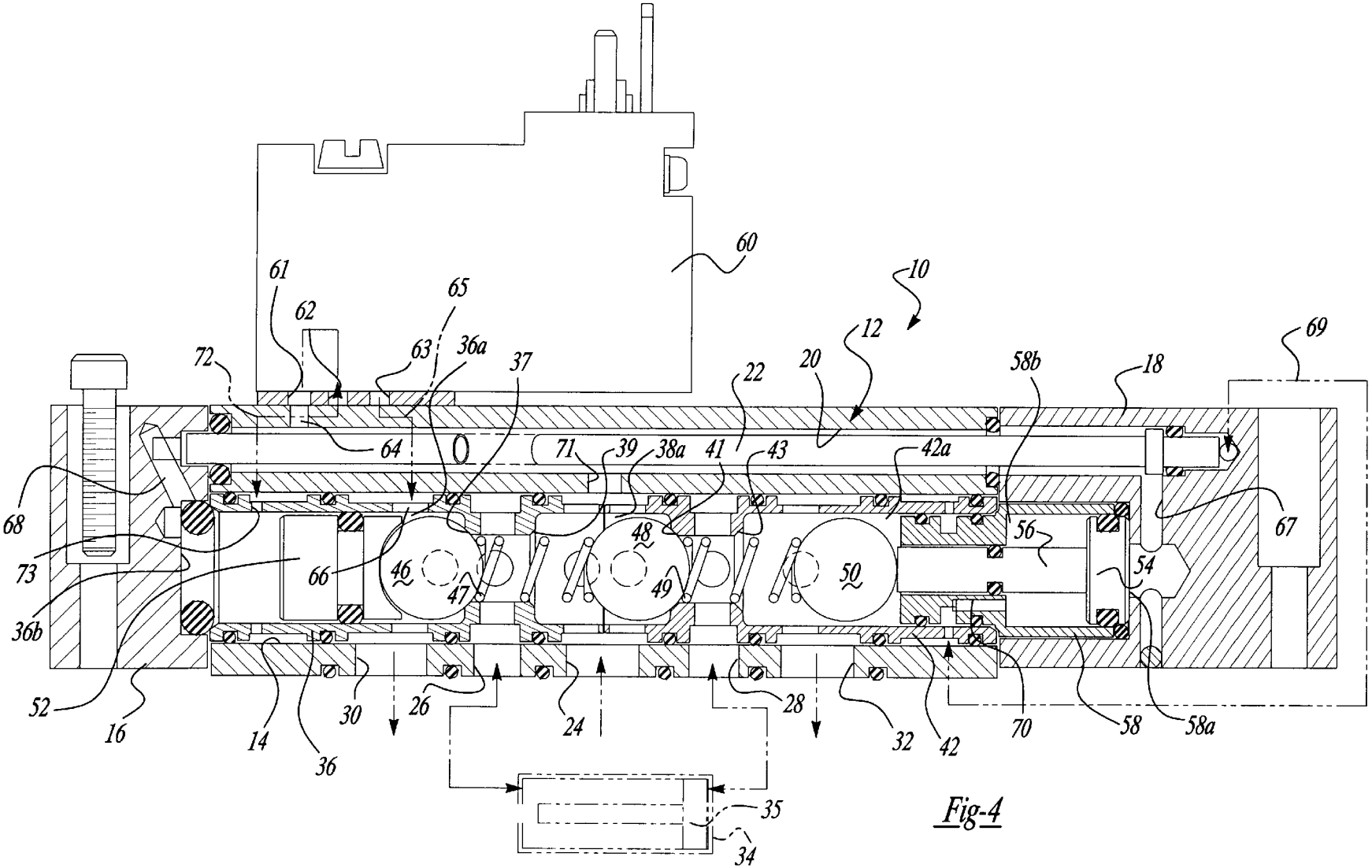
FIG. 4 is a view similar to that of FIG. 3, but illustrating the completion of movement of the movable valve mechanism to additionally provide full fluid communication between the first-mentioned working fluid load outlet and its associated exhaust port.

In FIG. 4, the "snap-reaction" force of the previously-compressed spring connector 49, coupled with the above-described rightwardly-directed force on the annular region of the piston 54 (surrounding the rod 56), has thus very rapidly urged the spherical ball valve element 50 completely away from its seat 43 at the exhaust chamber 42*a*. The rod 56 and the piston 54 have similarly been very rapidly urged to their fully-rightward limit of travel. In this condition, the load port 26 is now in full, free fluid communication with the fluid inlet 24 and is blocked from fluid communication with its corresponding exhaust port 30. Similarly, the load port 28 is blocked from fluid communication with the fluid inlet port 24, but is in full, free fluid communication with its exhaust port 32. This combination results in the exhausting of the right-hand portion of the cylinder 34 and the pressurization of the left-hand portion of the cylinder 34, thus causing the drive piston 35 to be urged rightwardly, as viewed in FIG. 4.

Figure 5:
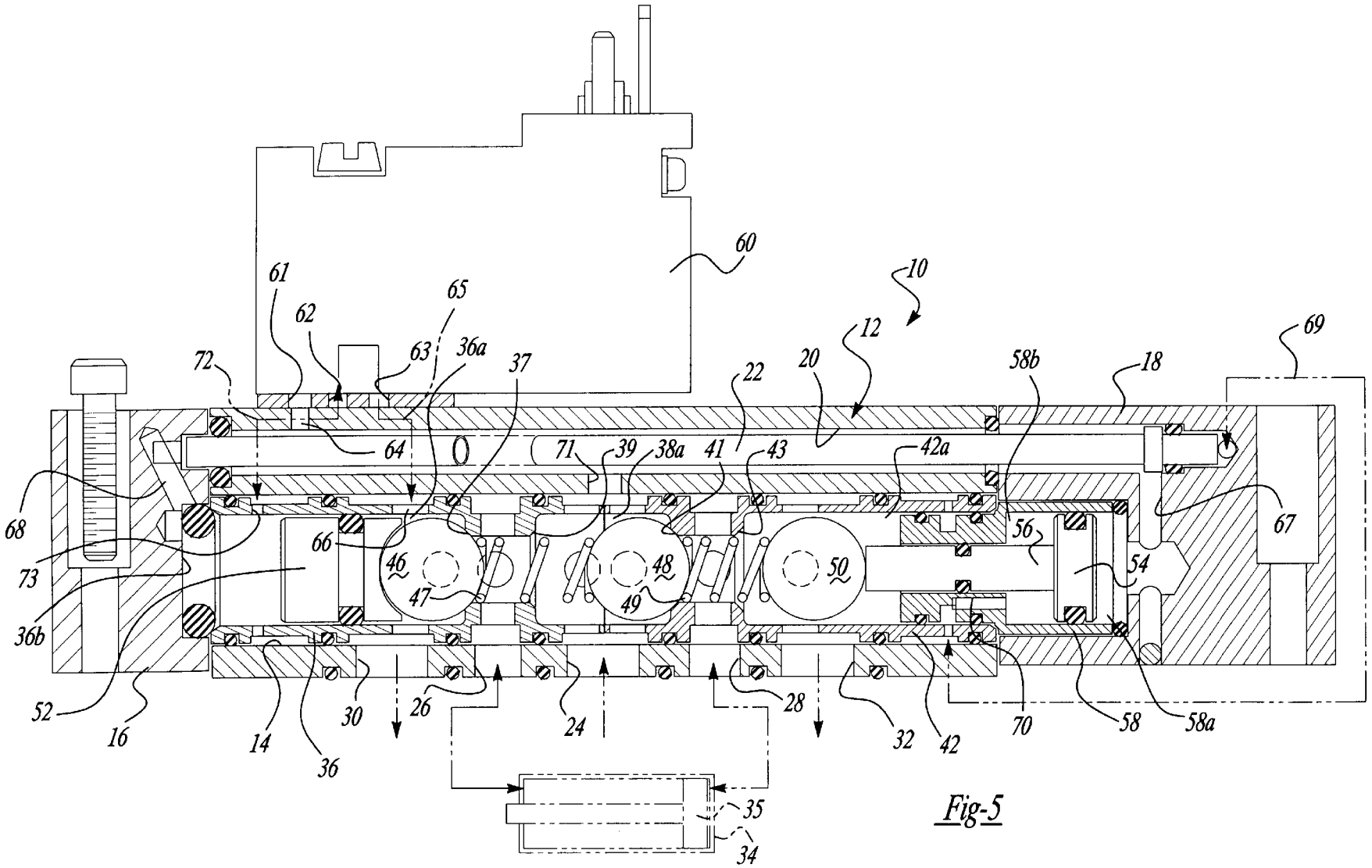
FIG. 5 is a view similar to that of FIG. 4, but illustrating the movable valve mechanism beginning the second half (or return portion) of its cycle of motion, wherein the movable valve mechanism has begun its opposite movement back toward the condition illustrated in FIG. 1.

In FIG. 5, the communication between the pilot port 61 and 62 is once again blocked, as the pilot has been returned by the operator to its de-energized condition, and therefore the pilot port 62 is again placed in communication with the pilot exhaust port 63. This in turn de-pressurizes the chamber 36*b* and relieves the pressure acting rightwardly upon the piston 52 and also on the annulus of the piston 54 surrounding the rod 56. Because the pressure in the chamber 58*a* acting leftwardly on the piston 54 is always present whenever the working pressurized pneumatic fluid supply through the inlet port 24 is "on", the piston 54 now has begun to move leftwardly. This urges the spherical ball valve element 50 leftwardly, compressing the spring connector 49, and ultimately transmitting leftward force to the valve element 48, the spring connector 47, the valve element 46, and the piston 52.

Figure 6:
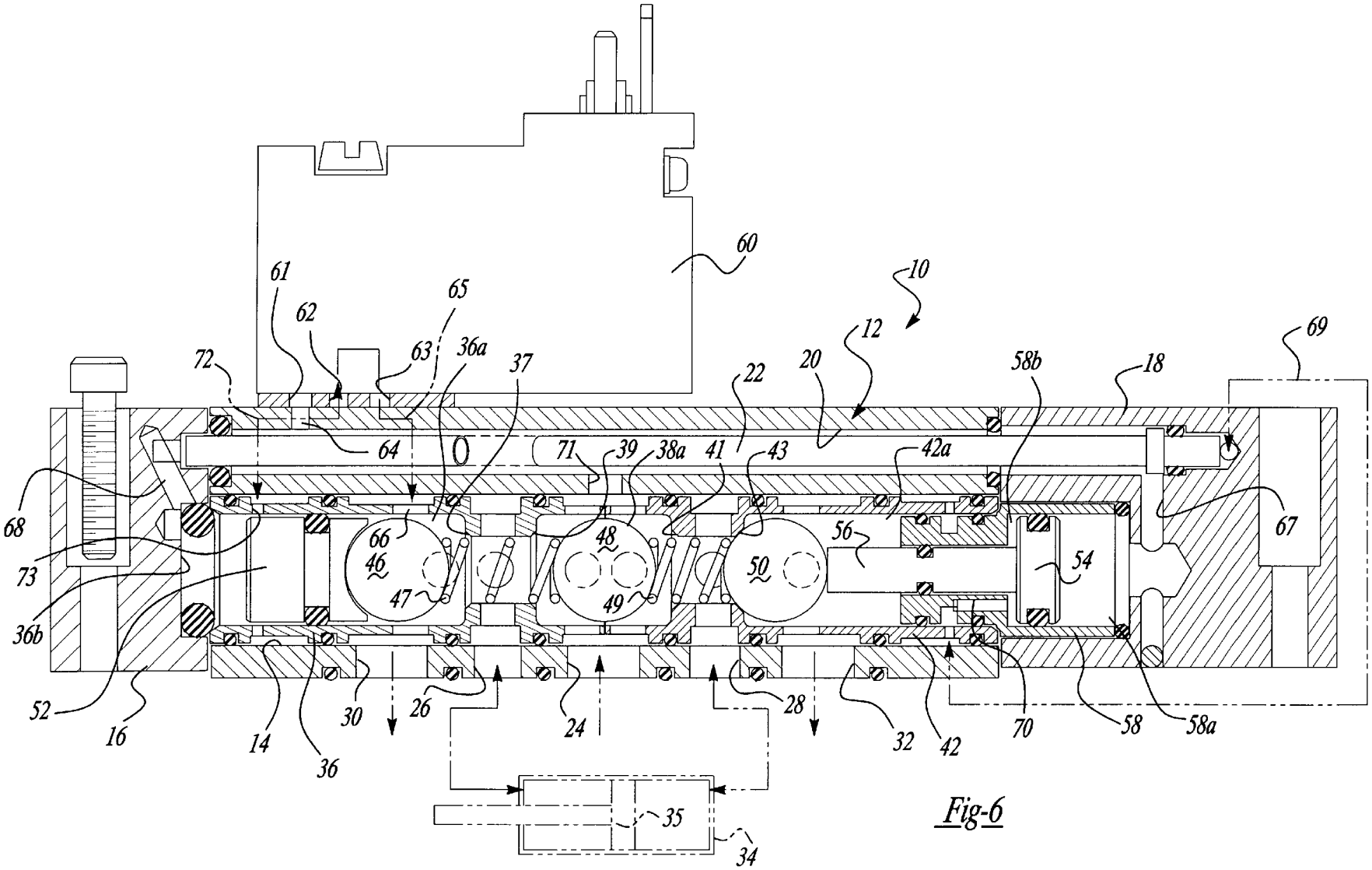
FIG. 6 is a view similar to that of FIG. 5, but illustrating further opposite movement of the movable valve mechanism toward a return to the condition shown in FIG. 1.

This leftward movement shown in FIG. 5 continues, as is illustrated in FIG. 6, to fully seat the spherical ball valve element 50 back on the seat 43, and to move the spherical ball valve elements 48 and 46 leftwardly until they return to their original seated positions illustrated in FIG. 1. In this return condition, as is described above in connection with FIG. 1, pressurized pneumatic working fluid is once again exhausted from the load port 26 by way of the chamber 36*a*, through the exhaust port 30, and pressurized working fluid is admitted from the inlet port 24, to the load port 28, and into the actuating cylinder 34, thus urging the drive piston 35 leftwardly, as viewed in the drawings.

The "snap-reaction" of the resiliently deformable spring connectors 47 and 49, as described sequentially above in connection with FIGS. 1 through 6, happens very rapidly, and the spherical ball valve elements 46, 48, and 50 also move very rapidly or "snap" to their respective positions at opposite ends of their travel. Also because of such built-in resiliency, as can be seen upon a comparison of the sequence of operation depicted in FIGS. 1 through 6, each ball valve element moves considerably (leftwardly or rightwardly) and compresses its adjacent spring connector before the next adjacent ball valve element begins to move in a coordinated reaction. Thus, the amount of time during which the pneumatic working fluid can be communicated from the inlet port 24 to both the load port 26 and to its exhaust port 30, or similarly to both the load port 28 and to its exhaust port 32, is substantially reduced to a minimum. This minimizing of the time for the valve mechanism to allow direct inlet-to-outlet flow (during transition movement) permits a reduction in the cross-over losses.

Figure 7:
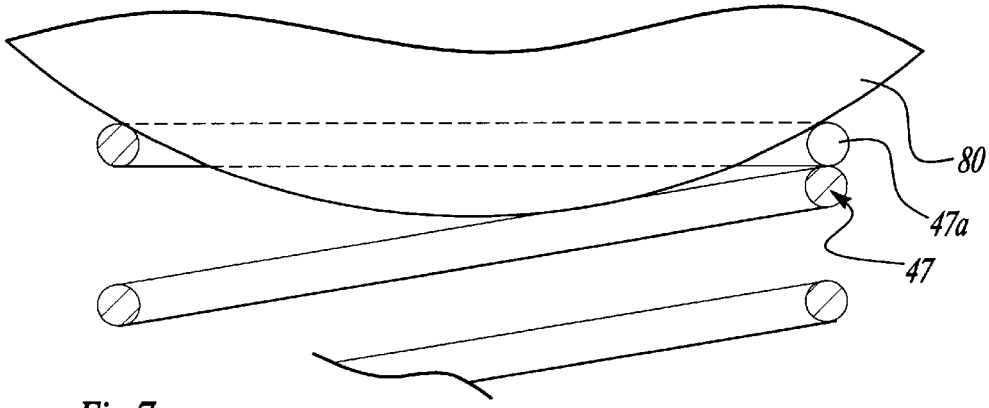
FIG. 7 is an enlarged detailed view of a preferred resilient coil spring connector with one end about to be ground to a desired spherically arcuate concave shape.
Figure 8:
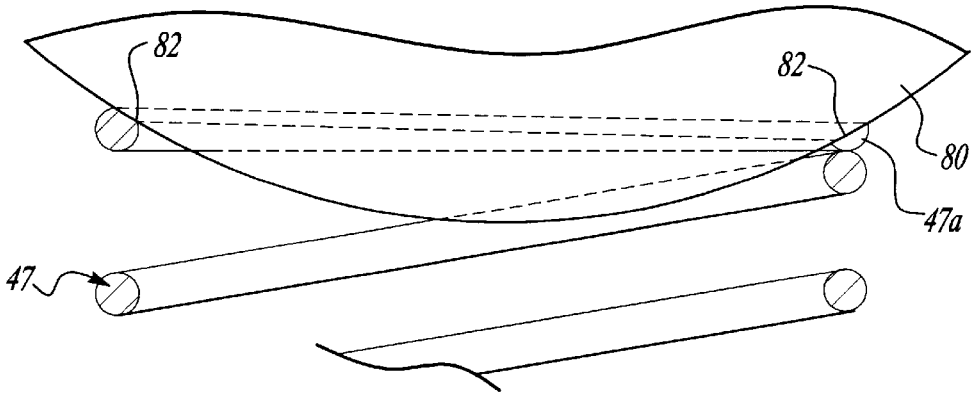
FIG. 8 is a detailed view similar to that of FIG. 7, but illustrating the grinding of the end of the resilient coil spring connector.

The preferred spherically-shaped valve elements 46, 48 and 50 can be composed of hard, suitably durable materials such as stainless steel or high-durometer rubbers, elastomers, or plastics. However, in order to prevent, or at least substantially minimize, excessive or inordinate wear, galling, or other such damage to the spherical valve elements (and thus prevent leakage due to improper seating), it has been found to be advantageous to form a generally spherical, arcuate, concave shape on both ends of the preferred coil spring connectors 47 and 49. Such a forming operation can be performed as illustrated in FIGS. 7 and 8, where an end of the coil spring connector 47 (for example) is being ground by a ball grinder 80 having a suitable radius that is complementary to the radius of the spherical valve elements 46, 48, and 50. This grinding operation, which is illustrated at its onset in FIG. 7 and at its completion in FIG. 8, not only serves to form the above-mentioned complementary spherical, arcuate concave shape at the end of the coil spring connector 47, but it also reduces the tendency of the free terminal ends of the end bights of the spring coils (indicated in FIGS. 7 and 8, for example, by reference numeral 47*a*) from presenting an abrupt, sharp or pointed end of the coil spring wire that would otherwise tend to gall, gouge or otherwise damage the abutting spherical valve elements.

Figure 9:
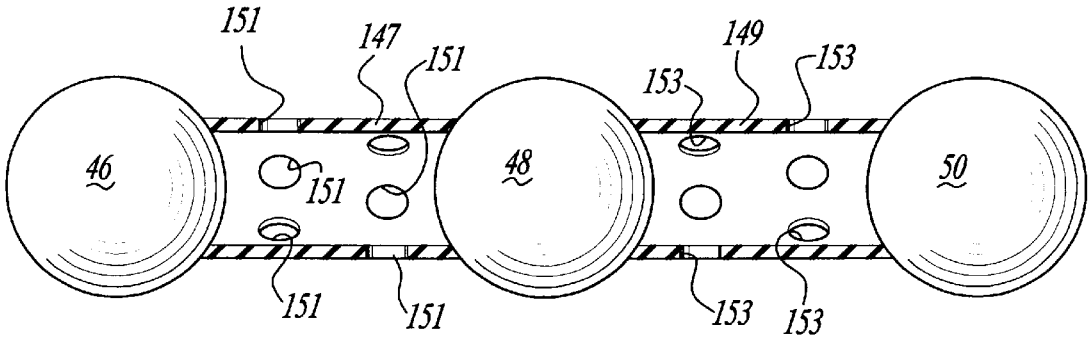
FIG. 9 illustrates an alternate embodiment of the resiliently deformable connectors abuttingly disposed between respective adjacent movable valve elements.

Although the coil spring-type connectors 47 and 49 illustrated in FIGS. 1 through 6 are highly preferred in carrying out the principles of the present invention, one skilled in the art will readily recognize that other resiliently deformable connectors can also be advantageously employed in control valves constructed according to the present invention. One example of such an alternate connector configuration is illustrated in FIG. 9, wherein the resilient connectors 147 and 149 are of a hollow tubular shape, having a plurality of openings extending radially through their respective walls in order to allow pneumatic fluid to flow therethrough. Such tubular resilient connectors could be composed of high-durometer rubber, suitable elastomers or plastics, or other natural or synthetic resiliently deformable, elastic materials, so long as the resultant modulus of elasticity of the connectors is suitable, given the magnitude of the forces involved in the operation of the control valve.

FIGS. 10 through 13 illustrate still another alternate embodiment of the present invention, as applied to a dual-piloted pneumatic control valve apparatus 210 that can function either as a four-way valve, or as dual three-way control valves acting in parallel, depending upon the "on/off" conditions of the two pilot operators. It should be noted that many of the components of the exemplary control valve apparatus illustrated in FIGS. 10 through 13 are either identical with, or at least functionally similar to, certain corresponding components or elements of the control valve apparatus 10 illustrated in FIGS. 1 through 6. Therefore, such corresponding components or elements in FIGS. 10 through 13 are indicated by reference numerals that are similar to those of the corresponding elements or components of FIGS. 1 through 6, except that the corresponding reference numerals in FIGS. 10 through 13 have two-hundred prefixes. It should also be noted that FIGS. 10 through 13 illustrate the alternate valve apparatus 210 is shown as sectioned through a horizontally-extending plane, rather than through the vertically-extending plane of FIGS. 1 through 6.

In FIGS. 10 through 13, in which the pilot operators 260*a* and 260*b* are merely illustrated in diagrammatic form, the control valve apparatus 210 includes a body 212, a single, main or central bore 214 (which has multiple steps therein), and end caps 216 and 218 at respective opposite ends. As in the control valve apparatus 10 of FIGS. 1 through 6 the control valve apparatus 210 has an inlet port 224 (not visible in FIGS. 10, 12 and 13), a pair of working fluid load ports 226 and 228, and a pair of corresponding respective exhaust ports 230 and 232, with these inlet, load and exhaust ports extending vertically and downwardly (as viewed in FIGS. 10 through 13) through the bottom of the valve body 212. As will be readily appreciated from the following discussion, the control valve apparatus 210 can be used in a wide variety of control applications, including those adapted for actuating a single cylinder-and-piston drive device, or even for actuating two or more cylinder-and-piston drive devices from a single, unitized control valve apparatus.

The control valve apparatus 210 also differs from the control valve apparatus 10 (of FIGS. 1 through 6) in that there is no secondary bore and no hollow flow tube provided within the valve body 212. In addition, and perhaps most notably, the preferred spherical valve element 48 in the center chamber 38*a* of the control valve apparatus 10 is replaced by a split-sphere valve element having two generally hemispherical valve elements or half-elements 248*a* and 248*b* disposed within the center chamber 238*a*. The hemispherical valve elements 248*a* and 248*b* preferably include recessed openings 245*a* and 245*b*, respectively, formed in their respective flat sides for receiving a central spring connector 255 therein. This central spring connector 255 resiliently biases the hemispherical valve elements 248*a* and 248*b* toward a spaced-apart relationship (see FIG. 11, for example), while permitting the hemispherical valve elements 248*a* and 248*b* to move either together in a mutually abutting relationship, as shown in FIG. 10, or separately in the spaced-apart relationship illustrated in FIG. 11.

Figure 10:
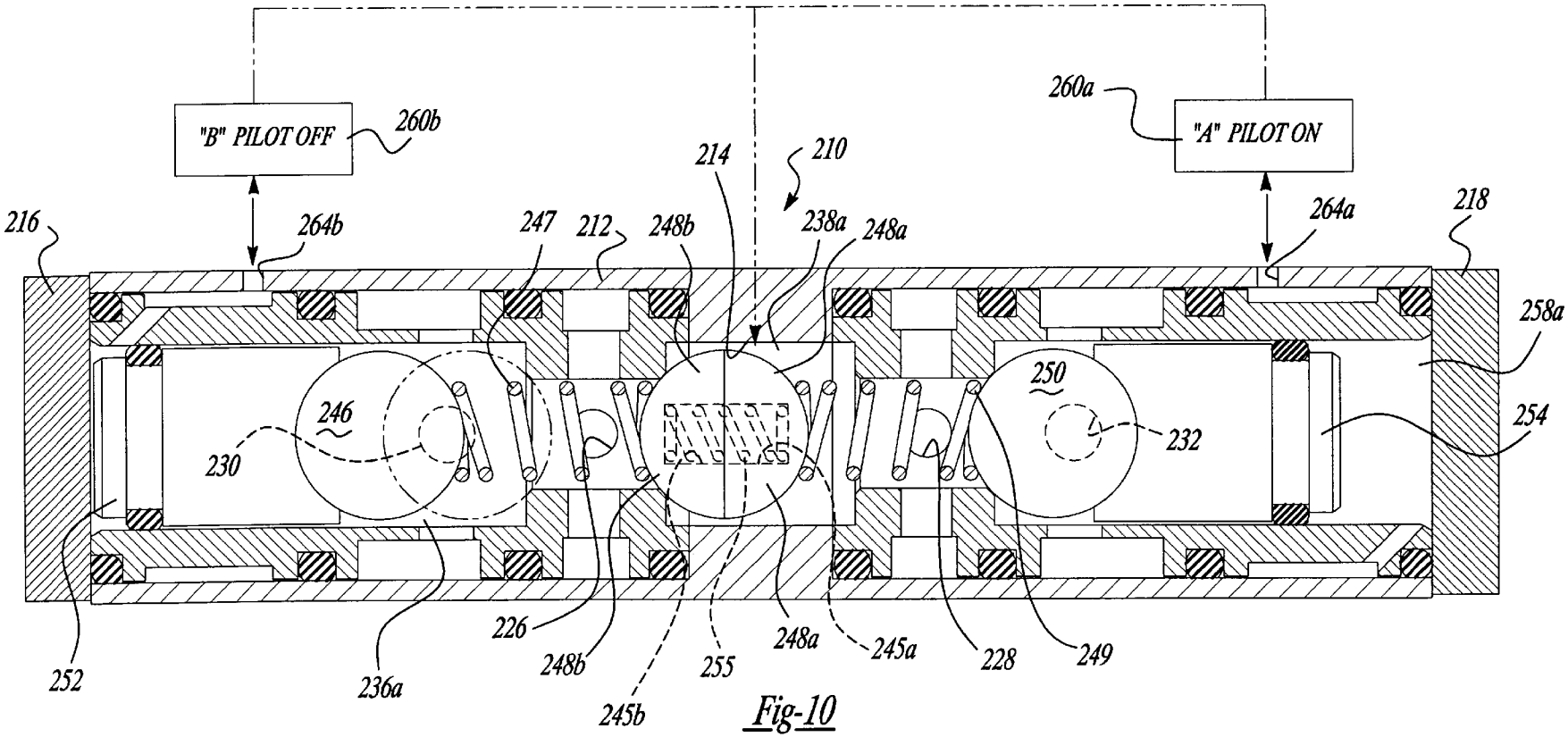
FIG. 10 illustrates an alternate embodiment of the invention in a control valve apparatus, with dual pilot operators, one of which is in a "pilot-off" condition, while the other is in a "pilot-on" condition, thus rendering the valve apparatus in a four-way operating mode.

When the pilot operator 260*a* is in its energized or "on" condition, and the pilot operator 260*b* is in a de-energized, or "off" condition, as illustrated in FIG. 10, pneumatic working fluid from the inlet port 224 (which is not visible in FIGS. 10, 12 and 13) is permitted to flow (in a manner similar to that described above in connection with the control valve apparatus 10 of FIGS. 1 through 6) through the chamber 238*a* and through a passage in the valve body 212 into the chamber 258*a* and forcibly act in a leftward direction (as viewed in FIG. 10) on the piston 254. Simultaneously in FIG. 10, because the pilot operator 260*b* is in a de-energized condition, no oppositely-acting pressurized pneumatic working fluid is acting in a rightward direction on the piston 252. Thus, the valve elements 246, 248*a*, 248*b*, and 250, along with the spring connectors 247, 255, and 249, are all urged leftwardly in order to permit pressurized pneumatic working fluid to flow from the inlet port 224, through the load port 228, and to a pneumatically-operated actuated device (not shown). The load port 228 is blocked from fluid communication with its associated corresponding exhaust port 232 in the condition shown in FIG. 10. In contrast, however, the load port 226 is in free fluid communication with its associated corresponding exhaust port 230, but is blocked from communication with the inlet port 224. In this illustrated condition, with the pilot operator 260*a* energized and the pilot operator 260*b* deenergized, the pneumatic control valve apparatus 210 functions as a four-way control valve.

Figure 11:
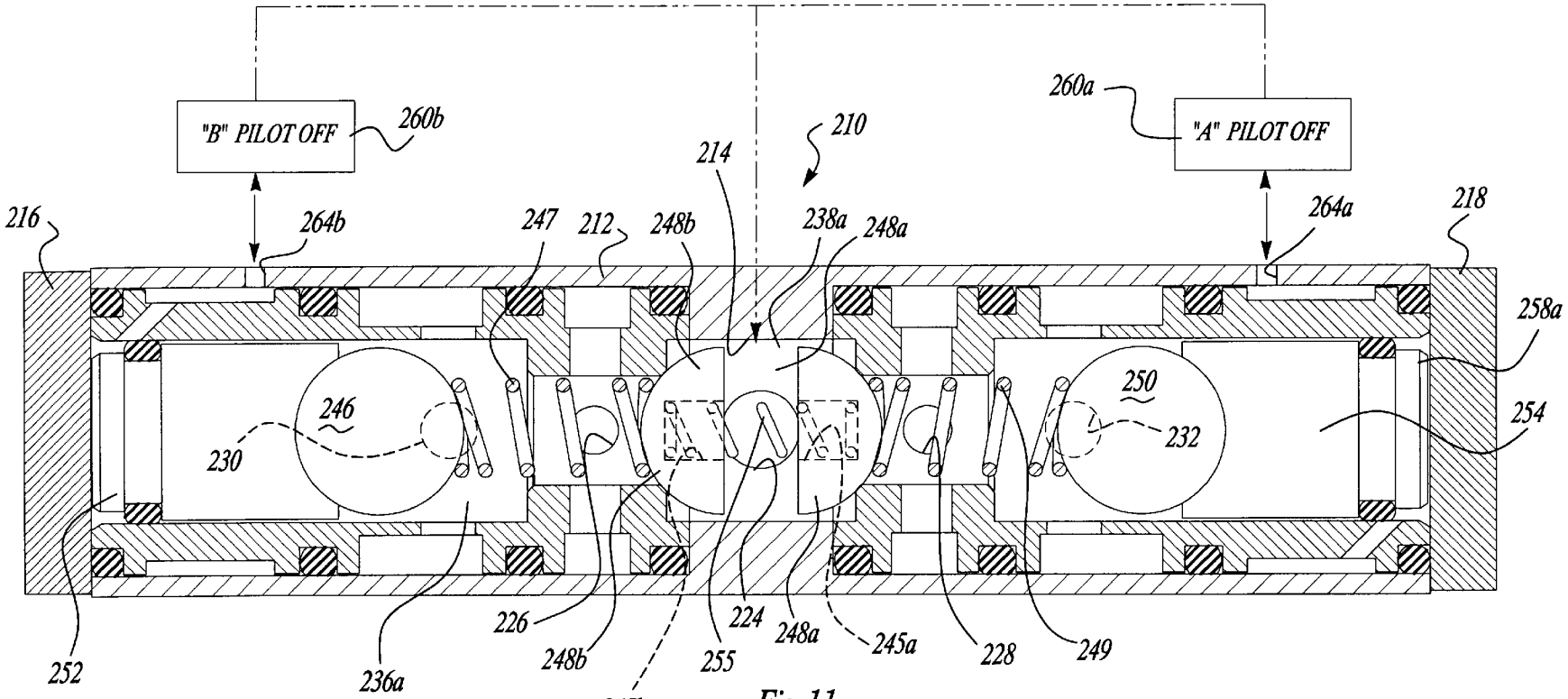
FIG. 11 is a view similar to that of FIG. 10, but illustrating the valve apparatus with both pilot operators in "pilot-off" conditions, thus functioning as dual, three-way valves in parallel with both valve portions in the exhaust mode.

In FIG. 11, both of the pilot operators 260*a* and 260*b* are in their de-energized or "off" conditions, thus allowing fluid communication between the load ports 228 and 226 and their respective corresponding exhaust ports 232 and 230. Because there is no opposing pressurized pneumatic working fluid acting on the outboard sides of the pistons 252 and 254, the force of the central biasing spring connector 255 is allowed to urge the hemispherical valve elements 248*a* and 248*b* apart, thus blocking flow from the inlet port 224 to either of the load ports 226 or 228. In this condition, with both pilot operators in their de-energized or "off" conditions, the valve apparatus 210 functions as parallel, dual three-way valves.

Figure 12:
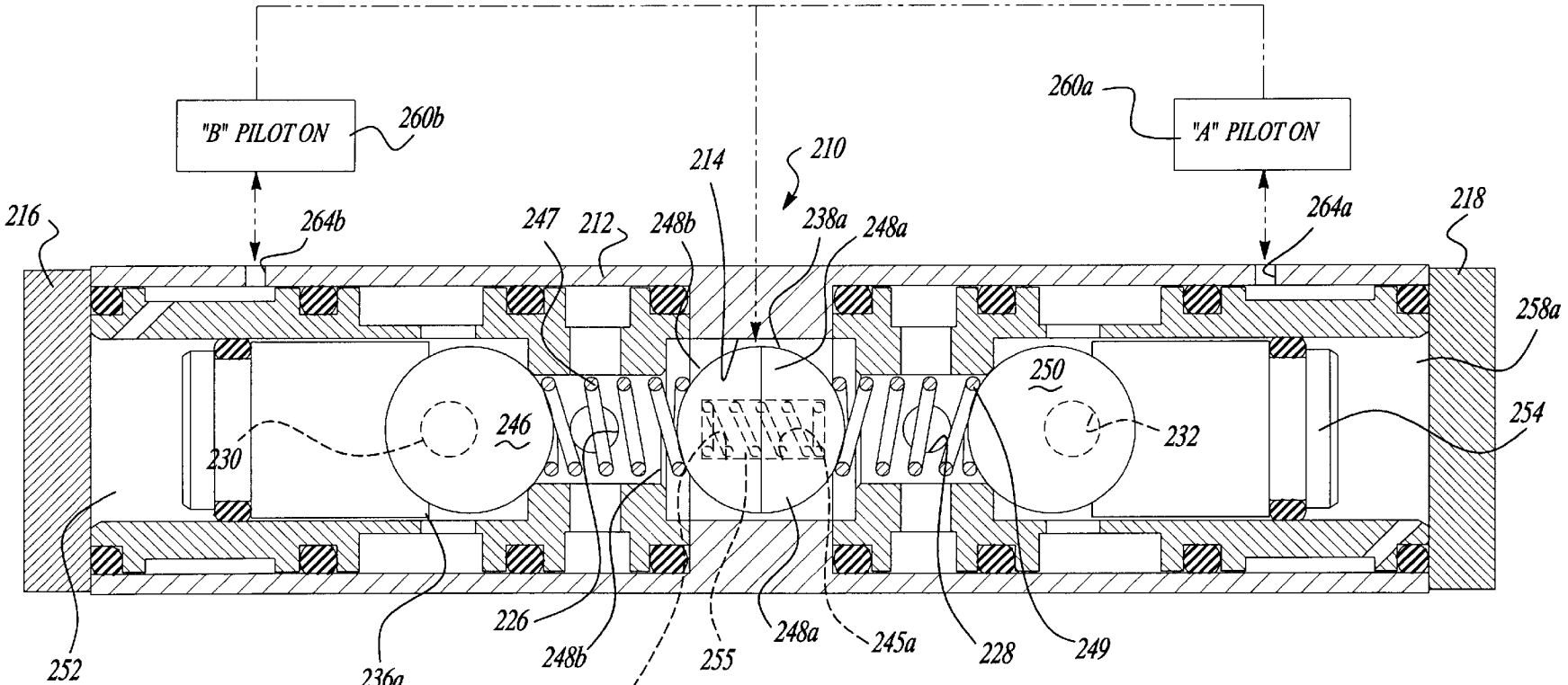
FIG. 12 is a view similar to that of FIGS. 10 and 11, but illustrating the control valve apparatus with both pilot operators in their "pilot-on" conditions, thus also operating as dual three-way valves in parallel with both valve portions in the "pressure-out" mode.

Similarly, as illustrated in FIG. 12, wherein both pilot operators 260*a* and 260*b* are energized or in their "on" conditions, the pistons 252 and 254 are both urged inwardly, toward the center of the valve body 12 and thus overcome the outwardly-biasing spring force of the central spring connector 255. This allows the hemispherical valve elements 248*a* and 248*b* to again be urged into abutting engagement with each other, thereby permitting flow of pressurized pneumatic working fluid from the inlet port 224 through both of the working fluid load ports 226 and 228 and on to one or more pneumatic cylinders or other fluid-operated actuating devices. In this condition, with both pilot operators 260 and 260*b* energized, the control valve apparatus 210 also operates as a parallel, dual three-way valve.

Figure 13:
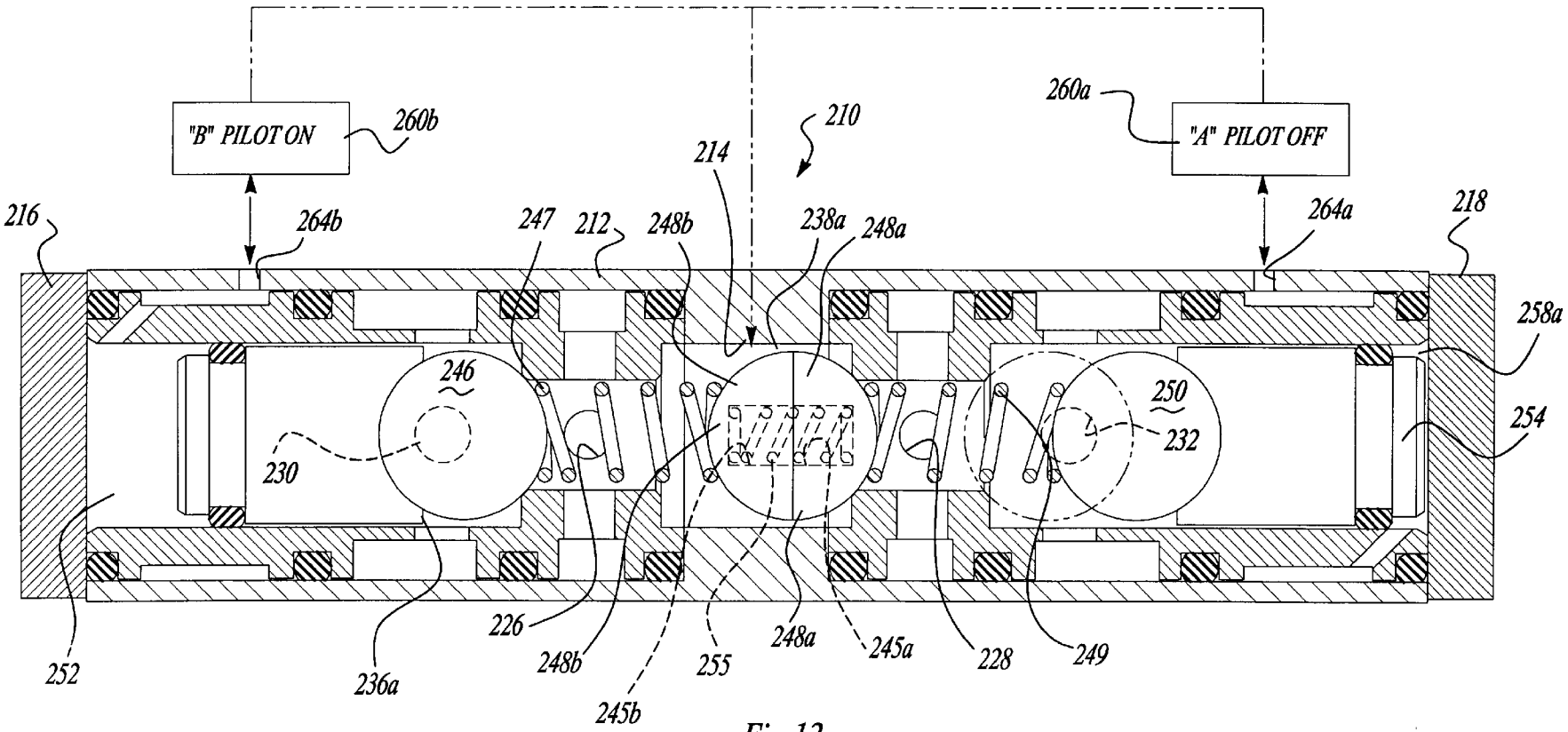
FIG. 13 is a view similar to that of FIGS. 10 through 12, but illustrating the pilot operators in the opposite condition from that of FIG. 10, thus operating again as a four-way valve.

Finally, as illustrated in FIG. 13, the pilot operator 260*a* is de-energized, or in its "off" condition, while the pilot operator 260*b* is in its energized or "on" condition, thus urging the valve elements and spring connectors into the opposite positions from those illustrated in FIG. 11. In this condition, in which the control valve apparatus 210 functions as a four-way valve, the pressurized pneumatic working fluid is permitted to flow from the inlet port 224, through the load port 226 and on to one or more pneumatic fluid operated actuating devices.

As can be readily appreciated by one skilled in the art, upon comparing the various operating conditions illustrated in FIGS. 10 through 13, the alternate control valve apparatus 210 can be used in a wide variety of applications. Such applications include the parallel operation of two or more actuating devices, the separate and independent operation of two or more actuating devices, or even more specific and precise control of a single actuating device where a wider variety of actuating conditions beyond those of a simple push-pull actuation are required.

Furthermore, although the principles of the present invention have been depicted for purposes of illustration in FIGS. 1 through 13 in valve configurations having two load ports and two corresponding exhaust ports, it should be noted that the principles of the invention are equally applicable in control valve configurations having only a single inlet, a single load port, and a single corresponding exhaust port. An example of such an application would be one adapted for the simple operation of a cylinder-and-piston actuating device having a piston that is resiliently biased by way of a return spring to its return position and forcibly moved against the bias of the return spring only when pressurized fluid is admitted to the interior of the cylinder. Such resilient return spring would serve to return the piston to its original position within the cylinder when such pressurized pneumatic working fluid is exhausted from the interior of the cylinder.

In all applications, however, including those illustrated by FIGS. 1 through 13, the resilient spring connectors permit a considerable amount of movement by one adjacent valve element before causing the rapid, "snap-reaction" movement of the other of the adjacent valve elements.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

I claim:

1. In a pneumatic fluid control valve apparatus having a valve body portion, a working fluid inlet in the valve body portion connectable to a source of pressurized pneumatic working fluid, at least one working fluid load outlet in the valve body portion, at least one working fluid exhaust port in the valve body portion, and a movable valve mechanism, the control valve apparatus being connectable to a pilot operator for selectively applying a pneumatic control fluid pressure to the movable mechanism in order to selectively communicate the load outlet with one of either the working fluid inlet or the working fluid exhaust port, the improvement wherein said movable valve mechanism includes a first movable valve element movably located within a first chamber within the valve body portion, said first chamber being in communication with the working fluid load outlet, a second movable valve element movably located within a second chamber within the valve body portion, said second chamber being in communication with said first chamber, with said working fluid inlet, and with said working fluid load outlet, a deformable connector generally abuttingly disposed between said first and second movable valve elements for deformably transmitting coordinated motion therebetween, said deformable connector deforming in response to movement of one of said first and second movable valve elements before transmitting said coordination motion to the other of said first and second movable valve elements, said movable valve elements and deformable connector being arranged in a substantially straight, linear in-line orientation along the paths of movement of said movable valve elements, said first and second chambers each having at least one substantially rigid valve seat therein engageable with said first and second movable valve elements respectively, said movable valve elements each being of a substantially spherical shape and each being resiliently deformable in order to compliantly engage the respective valve seat in said first and second chambers respectively said deformable connector being a resiliently deformable coil spring and being the sole interconnection between said movable valve elements for transmitting said coordinated motion therebetween.

2. The improvement according to claim 1, wherein said first chamber valve seat is sealing engageable by said first movable valve element in order to selectively block communication between said first and second chambers and between said first chamber and said working fluid load outlet, said second chamber valve seat being sealingly engageable by said second movable valve element in order to selectively block said communication between said first and second chambers and between said second chamber and said working fluid load outlet.

3. The improvement according to claim 2, wherein said movable valve mechanism further includes a piston movably disposed adjacent said first chamber generally in an abutting relationship with said first movable valve element for selectively imparting motion thereto.

4. The improvement according to claim 3, wherein said fluid control apparatus further includes a pilot apparatus operable for selectively controlling movement of said piston.

5. The improvement according to claim 1, wherein said fluid control valve apparatus further includes a pilot apparatus operable for selectively controlling movement of said movable valve elements.

6. The improvement according to claim 1, wherein said coil spring has at least one concave generally spherical arcuate end portion thereof in a generally abutting relationship with an adjacent one of said substantially spherical movable valve elements.

7. The improvement according to claim 6, wherein said concave generally spherical arcuate end position is formed in an end bight portion of said coil spring.

8. The improvement according to claim 1, wherein said movable valve elements are composed of a metallic material.

9. In a pneumatic fluid control valve apparatus having a valve body portion, a working fluid inlet in the valve body portion connectable to a source of pressurized pneumatic working fluid, a pair of working fluid load outlets in the valve body portion, and a movable valve mechanism, the control valve apparatus being connectable to a pilot operator for selectively applying a pneumatic control fluid pressure to the movable valve mechanism in order to communicate a selected one of the load outlets with the working fluid inlet, the improvement wherein said movable valve mechanism includes a first movable valve element movably located within a first chamber within the valve body portion, said first chamber being in communication with a first of the working fluid load outlets, a second movable valve element movably located within a second chamber within the valve body portion, said second chamber being in communication with said first chamber, with said working fluid inlet, and with said first working fluid load outlet, a third movable valve element movably located within a third chamber within the valve body portion, said third chamber being in communication with said second chamber and with a second of said working fluid load outlets, a first deformable connector generally abuttingly disposed between said first and second movable valve elements for deformably transmitting coordinated motion therebetween, and a second deformable connector generally abuttingly disposed between said second and third movable valve elements for deformably transmitting coordinated motion therebetween, each of said deformable connectors deforming in response to movement of an adjacent one of said movable valve elements before transmitting said respective coordinated motion to the other adjacent one of said movable valve elements, said movable valve elements and said deformable connectors being arranged in a substantially straight, linear in-line orientation along the paths of movement of said movable valve elements, said first, second and third chambers each having at least one substantially rigid valve seat therein engageable with said first, second and third movable valve elements respectively, said movable valve elements each being of a substantially spherical shape and each being resiliently deformable in order to compliantly engage the respective valve seat in said first, second and third chambers respectively, said deformable connectors being resiliently deformable coil springs and being the sole interconnection between respective adjacent pairs of said movable valve elements for transmitting said coordinated motion therebetween.

10. The improvement according to claim 9, wherein said first chamber valve seat is sealingly engageable by said first movable valve clement in order to selectively block communication between said first and second chambers and between said first chamber and said first working fluid load outlet, said second chamber valve seats being disposed generally at opposite ends of said second chamber, one of said second chamber valve seats being sealingly engageable by said second movable valve element in order to selectively block said communication between said first and second chambers and between said second chamber and said first working fluid load outlet, the other of said second chamber valve seats being sealingly engageable by said second movable valve element in order to selectively block said communication between said second and third chambers and between said second chamber and said second working fluid load outlet, said third chamber valve seat being sealingly engageable by said third movable valve element in order to selectively block said communication between said second and third chambers and between said third chamber and said second working fluid load outlet.

11. The improvement according to claim 10, wherein said fluid control valve apparatus has first and second working fluid exhaust ports in the valve body portion in communication with the atmosphere, said first working fluid exhaust port being in communication with said first chamber, and said second working fluid exhaust port being in communication with said third chamber, said sealing engagement of said first chamber valve seat by said first movable valve element also selectively blocking communication between said first working fluid inlet and said first working fluid exhaust port, and said sealing engagement of said third chamber valve seat by said third movable valve element also selectively blocking communication between said second working fluid outlet and said second working fluid exhaust port.

12. The improvement according to claim 11, wherein said fluid control valve apparatus further includes a pilot apparatus operable for selectively controlling movement of said movable valve elements.

13. The improvement according to claim 11, wherein said movable valve mechanism further includes a first piston movably disposed adjacent said first chamber generally in an abutting relationship with said first movable valve element for selectively imparting motion thereto, and a second piston movably disposed adjacent said third chamber generally in an abutting relationship with said third movable valve element for imparting motion thereto.

14. The improvement according to claim 13, wherein said fluid control apparatus further includes a pilot apparatus operable for selectively controlling movement of said first and second pistons.

15. The improvement according to claim 10, wherein said movable valve mechanism further includes a first piston movably disposed adjacent said first chamber generally in an abutting relationship with said first movable valve element for selectively imparting motion thereto, and a second piston movably disposed adjacent said third chamber generally in an abutting relationship with said third movable valve element for imparting motion thereto.

16. The improvement according to claim 15, wherein said fluid control apparatus further includes a pilot apparatus operable for selectively controlling movement of said first and second pistons.

17. The improvement according to claim 9, wherein said fluid control valve apparatus further includes a pilot apparatus operable for selectively controlling movement of said movable valve elements.

18. The improvement according to claim 9, wherein each of said deformable connectors has at least one concave generally spherical arcuate end portion thereof in a generally abutting relationship with an adjacent one of said spherical movable valve elements.

19. The improvement according to claim 18, wherein said concave generally spherical arcuate end portions are formed in respective end bight portions of said coil springs.

20. The improvement according to claim 9, wherein said movable valve elements arc composed of a metallic material.

21. In a pneumatic fluid control valve apparatus having a valve body portion, a working fluid inlet in the valve body portion connectable to a source of pressurized pneumatic working fluid, a pair of working fluid load outlets in the valve body portion, and a movable valve mechanism, the control valve apparatus being connectable to a pilot operator for selectively applying a pneumatic control fluid pressure to the movable valve mechanism in order to communicate a selected one of the load outlets with the working fluid inlet, the improvement wherein said movable valve mechanism includes a first movable valve element movably located within a first chamber within the valve body portion, said first chamber being in communication with a first of the working fluid load outlets, a second movable valve element movably located within a second chamber within the valve body portion, said second chamber being in communication with said first chamber, with said working fluid inlet, and with said first working fluid load outlet, a third movable valve element movably located within a third chamber within the valve body portion, said third chamber being in communication with said second chamber and with a second of said working fluid load outlets, a first deformable connector generally abuttingly disposed between said first and second movable valve elements for deformably transmitting coordinated motion therebetween, and a second deformable connector generally abuttingly disposed between said second and third movable valve elements for deformably transmitting coordinated motion therebetween, each of said deformable connectors deforming in response to movement of an adjacent one of said movable valve elements before transmitting said respective coordinated motion to the other adjacent one of said movable valve elements, said second movable valve element being comprised of two second movable valve half-elements engageable with one another into a mutually abutting relationship within said second chamber, said half-elements also being disengageable from each other into a spaced-apart relationship within said second chamber, said movable valve mechanism further including a third deformable connector disposed between said half-elements and biasing said half-elements toward said spaced-apart relationship.

22. The improvement according to claim 21, wherein said first chamber has a first chamber valve seat therein, said first chamber valve seat being sealingly engageable by said first movable valve element in order to selectively block communication between said first and second chambers and between said first chamber and said first working fluid load outlet, said second chamber having a pair of second chamber valve seats, said second chamber valve seats being disposed generally at opposite ends of said second chamber, one of said second chamber valve seats being sealingly engageable by one of said second movable valve half-elements in order to selectively block said communication between said first and second chambers and between said second chamber and said first working fluid load outlet the other of said second chamber valve seats being sealingly engageable by the other of said second movable valve half-elements in order to selectively block said communication between said second and third chambers and between said second chamber and said second working fluid load outlet, said third chamber having a third chamber valve scat therein, said third chamber valve seat being sealingly engageable by said third movable valve element in order to selectively block said communication between said second and third chambers and between said third chamber and said second working fluid load outlet.

23. The improvement according to claim 22, wherein said fluid control valve apparatus has first and second working fluid exhaust ports in the valve body portion in communication with the atmosphere, said first working fluid exhaust port being in communication with said first chamber, and said second working fluid exhaust port being in communication with said third chamber, said sealing engagement of said first chamber valve seat by said first movable valve element also selectively blocking communication between said first working fluid inlet and said first working fluid exhaust port, and said sealing engagement of said third chamber valve seat by said third movable valve element also selectively blocking communication between said second working fluid outlet and said second working fluid exhaust port.

24. The improvement according to claim 23, wherein said fluid control valve apparatus further includes a pilot apparatus operable for selectively controlling movement of said movable valve elements.

25. The improvement according to claim 23, wherein said movable valve mechanism further includes a first piston movably disposed within said first chamber generally in an abutting relationship with said first movable valve element for selectively imparting motion thereto, and a second piston movably disposed within said third chamber generally in an abutting relationship with said third movable valve element for imparting motion thereto.

26. The improvement according to claim 25, wherein said fluid control apparatus further includes a pilot apparatus operable for selectively controlling movement of said first and second pistons.

27. The improvement according to claim 22, wherein said movable valve mechanism further includes a first piston movably disposed adjacent said first chamber generally in an abutting relationship with said first movable valve element for selectively imparting motion thereto, and a second piston movably disposed adjacent said third chamber generally in an abutting relationship with said third movable valve element for imparting motion thereto.

28. The improvement according to claim 27, wherein said fluid control apparatus further includes a pilot apparatus operable for selectively controlling movement of said first and second pistons.

29. The improvement according to claim 22, wherein each of said movable valve elements has a generally spherical arcuate shape at least adjacent its respective valve seat.

30. The improvement according to claim 21, wherein said fluid control valve apparatus further includes a pilot apparatus operable for selectively controlling movement of said movable valve elements.

31. The improvement according to claim 21, wherein said movable valve elements and said deformable connectors are arranged in a substantially straight, linear in-line orientation along the paths of movement of said movable valve elements.

32. The improvement according to claim 21, wherein each of said first and third movable valve elements is of a generally spherical shape, said second movable valve half-elements each being of a generally hemispherical shape and forming a generally spherical shape when in their mutually-abutting relationship.

33. The improvement according to claim 21, wherein said deformable connectors are resiliently deformable.

34. The improvement according to claim 21, wherein said deformable connectors are resiliently deformable coil springs.

35. The improvement according to claim 21, wherein each of said first and third movable valve elements is of a generally spherical shape, said second movable valve half-elements each being of a generally hemispherical shape and forming a generally spherically shaped movable valve element when in their mutually-abutting relationship, each of said first and second deformable connectors having at least one concave generally spherical arcuate end portion thereof in a generally abutting relationship with an adjacent one of said generally spherical movable elements.

36. The improvement according to claim 35, wherein said deformable connectors are resiliently deformable coil springs, said concave generally spherical arcuate end portions being formed in respective end bight portions of said coil springs.

37. The improvement according to claim 21, wherein said movable valve elements are composed of a metallic material.

38. The improvement according to claim 21, wherein said movable valve elements are composed of an elastomeric material.

* * * * *

UNITED STATES PATENT AND TRADEMARK OFFICE

CERTIFICATE OF CORRECTION

PATENT NO. : 5,918,631

DATED : July 6, 1999

INVENTOR(S) : Weiler, Jr., et al

It is certified that error appears in the above-identified patent and that said Letters Patent is hereby corrected as shown below:

Column 11, line 8, Claim 2, "sealing" should be --sealingly--.

Column 12, line 22, Claim 10, "clement" should be --element--.

Column 14, line 24, Claim 22, "scat" should be -- seat --.

Signed and Sealed this

Twenty-ninth Day of February, 2000

*Attest:*

*Attesting Officer*

Q. TODD DICKINSON

*Commissioner of Patents and Trademarks*